US005081684A

United States Patent [19]

House

[11] Patent Number: 5,081,684

[45] Date of Patent: Jan. 14, 1992

[54] SHALLOW LOUDSPEAKER WITH SLOTTED MAGNET STRUCTURE

[75] Inventor: William N. House, Bloomington, Ind.

[73] Assignee: Harman International Industries, Incorporated, Northridge, Calif.

[21] Appl. No.: 671,684

[22] PCT Filed: Oct. 12, 1990

[86] PCT No.: PCT/US89/04501

§ 371 Date: Mar. 21, 1991

§ 102(e) Date: Mar. 21, 1991

[87] PCT Pub. No.: WO90/05435

PCT Pub. Date: May 17, 1990

Related U.S. Application Data

[63] Continuation of Ser. No. 268,376, Nov. 17, 1988, abandoned.

[51] Int. Cl.[5] ..... H04R 25/00

[52] U.S. Cl. ..... 381/199; 381/202

[58] Field of Search ..... 381/184, 177, 192, 194, 381/199, 201, 202, 203, 200, 204

[56] References Cited

U.S. PATENT DOCUMENTS

| | | | |
|---|---|---|---|
| 1,766,612 | 6/1930 | DeForest | 381/199 |
| 2,498,825 | 2/1950 | Richards | 381/197 |
| 2,858,377 | 10/1958 | Levy | 381/199 |
| 3,153,463 | 10/1964 | Novak . | |
| 4,379,951 | 4/1983 | Gabr | 381/186 |
| 4,385,210 | 5/1983 | Marquiss | 381/186 |
| 4,508,941 | 4/1985 | Wiggins | 381/199 |
| 4,520,237 | 5/1985 | Murakami | 381/199 |

FOREIGN PATENT DOCUMENTS

| | | | |
|---|---|---|---|
| 0027600 | 3/1981 | Japan | 381/199 |

*Primary Examiner*—Forester W. Isen

*Attorney, Agent, or Firm*—Barnes & Thornburg

[57] ABSTRACT

An electrodynamic transducer includes a magnet structure (14, 28, 30) having inner (31) and outer (14) poles defining between them an air gap (17), a diaphragm (12), and a voice coil (44). Openings (18) are provided in the outer pole (14), the openings (18) extending generally parallel with the air gap (17) and the direction of motion of the voice coil (44) in the air gap (17). The voice coil (44) is coupled to the diaphragm (12) by ribs (40) extending transversely across the air gap (17) and through the openings (18) for securing the voice coil (44) to the diaphragm (12).

10 Claims, 1 Drawing Sheet

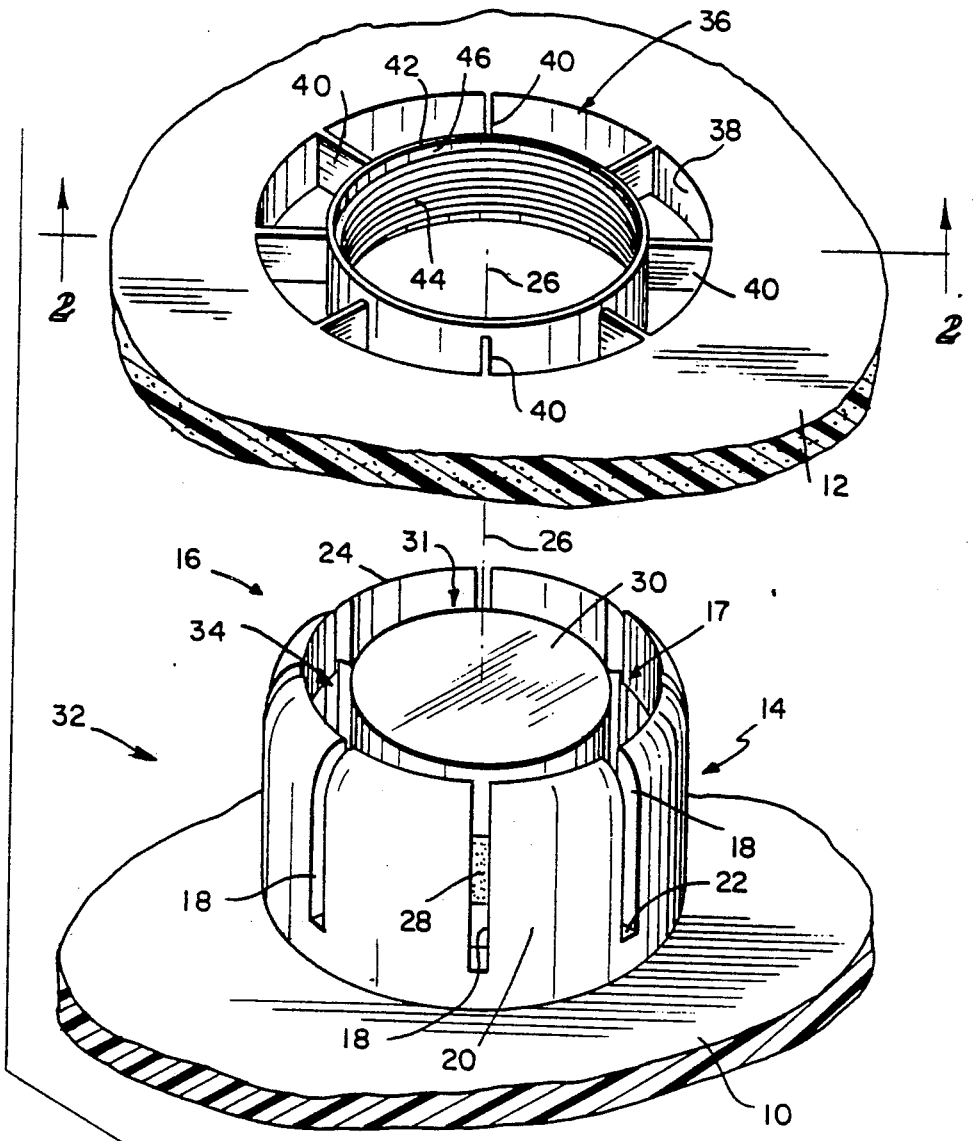
FIG. 1
FIG. 2
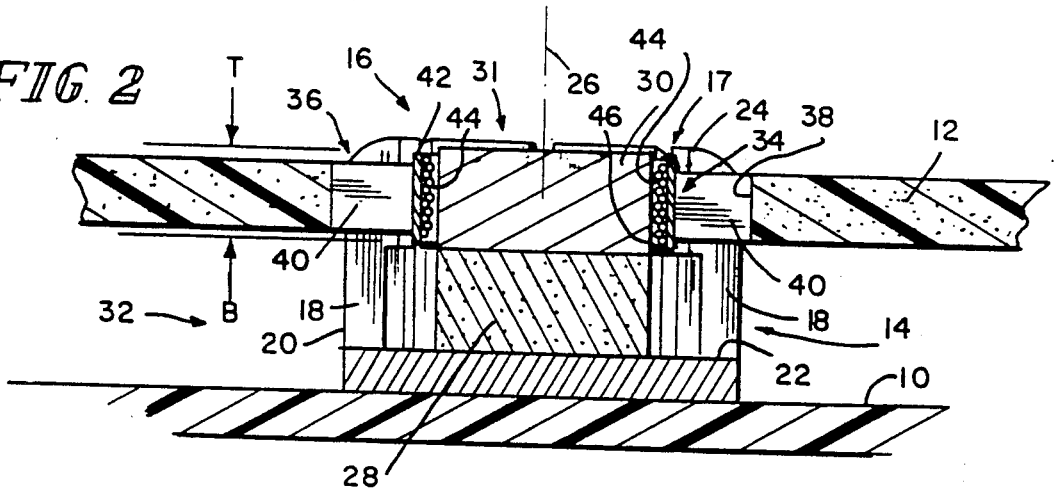

SHALLOW LOUDSPEAKER WITH SLOTTED MAGNET STRUCTURE

This application is a continuation application of U.S. Ser. No. 07/268,376 filed Nov. 17, 1988, now abandoned.

This invention relates to electrodynamic transducers and more specifically to a novel configuration of the magnet structure and diaphragm which permits a shallower transducer to be realized than is permitted by prior art designs.

Various shallow and flat diaphragm designs are known. There are, for example, the designs illustrated by the following U.S. Pat. Nos. 1,766,612; 2,498,825; 2,858,377; 3,153,463; 4,379,951; 4,385,210; 4,508,941; and, 4,520,237. This listing is only intended as illustrative of the prior art and specifically is not intended as a representation that no closer prior art exists to the claimed invention. Although the listed prior art generally illustrates what are believed to be the shallowest transducer designs available with existing technology, the illustrated designs suffer from the weakness that the transducer must be designed with space between the diaphragm and magnet assembly when the voice coil is unexcited so that no collisions occur between the diaphragm and magnet assembly when the voice coil is excited. For example, in a transducer whose design is intended to provide a 0.6 inch (1.5 cm) peak to peak excursion, a space of at least 0.3 inch (0.75 cm) must be provided between the diaphragm and adjacent surfaces of the magnet assembly when the voice coil is unexcited. Of course, collisions between the diaphragm and magnet assembly must be avoided to prevent the audible distortion which accompanies such collisions.

It is an object of the present invention to provide an electrodynamic transducer structure in which it is not necessary to provide space between the diaphragm and magnet structure in the direction in which excursion of the diaphragm occurs.

According to the invention, an electrodynamic transducer includes a magnet structure including a first inner, or core, pole and a second outer pole, or shell, defining an air gap between them. The air gap has a generally cylindrical configuration. The transducer further includes a diaphragm, a voice coil having a generally cylindrical configuration for displacement axially within the air gap, and means for coupling the voice coil to the diaphragm so that movement of the voice coil in response to current flow through the voice coil generates corresponding movement of the diaphragm. Openings are provided in the outer pole. The openings extend generally parallel with the axes of the air gap and voice coil. The means for coupling the voice coil to the diaphragm comprises ribs extending from the voice coil with a component radially of the axes of the air gap and voice coil. The ribs are secured to the diaphragm.

Illustratively, the diaphragm comprises an opening having an inner sidewall, and the ribs are secured at their radially outer extents to the inner sidewall, the diaphragm is generally planar, and the inner sidewall is right circular cylindrical.

Further, illustratively, the air gap and voice coil are generally right circular cylindrical in configuration.

According to the illustrative embodiment, the openings in the outer pole are generally slot-shaped. The openings are elongated in the direction of the air gap and voice coil axes and narrow in a direction transverse to the air gap and voice coil axes. Also according to the illustrative embodiment, the ribs are elongated in the direction of the air gap and voice coil axes and narrow in a direction transverse to the air gap and voice coil axes.

According to the illustrative embodiment, the means for coupling the voice coil to the diaphragm further comprises a voice coil form for supporting the voice coil in the air gap. The ribs are secured at their radially inner extents to the voice coil form.

The invention may best be understood by referring to the following description and accompanying drawings which illustrate the invention. In the drawings:

FIG. 1 illustrates an exploded fragmentary perspective view of an electrodynamic transducer constructed according to the present invention; and FIG. 2 illustrates a fragmentary sectional side elevational view of the electrodynamic transducer of FIG. 1, taken generally along section lines 2—2 of FIG. 1.

Referring to both figures, the transducer includes a back plate 10 which can be constructed from any suitable material such as a metal or filled or unfilled resin. Back plate 10 extends outward from the transducer components illustrated in the figures and typically supports the outer perimeter (not shown) of the diaphragm 12 of the transducer by some suitable configuration which is not the subject of this invention. An outer pole, or shell, 14 is mounted, such as by a suitable adhesive, on back plate 10. Shell 14 is constructed from a material which has a high magnetic permeability, a ferromagnetic material. Shell 14 defines within it a generally right circular cylindrical space 17, open at the top 16. Slots 18 extend along the length of the sidewall 20 of shell 14 from its floor 22 to its upper lip 24. Slots 18 are elongated in the direction of the axis 26 of the right circular cylindrical space and narrow in the direction around sidewall 20 transverse to axis 26.

A right circular cylindrical ferromagnet 28 and a high magnetic permeability, right circular cylindrical slug 30 are stacked on the floor 22 of shell 14 to form the inner, or core, pole 31 of a yoke 32 with shell 14. A right circular cylindrical air gap 34 coaxial with space 17 and core pole 31 is thus formed.

Diaphragm 12 includes an inner circular opening 36 defined by a right circular cylindrical wall 38 having a radius larger than the radius of shell 14 so that diaphragm 12 will slide down around the shell 14. Several ribs 40 extend radially inward from wall 38 and join the outer sidewall of a right circular cylindrical voice coil form 42. The dimensions of ribs 40 and voice coil form 42 are such that the ribs 40 move freely without contact in slots 18 and voice coil form 42 and the voice coil 44 which is provided on the radially inner surface 46 thereof move freely without contact in air gap 34.

It will be appreciated with reference to FIG. 2 that the entire excursion of diaphragm 12 between its peak limits T and B is below the level of lip 24 of shell 14. Thus, the object is achieved of providing a transducer structure wherein space between the diaphragm 12 and magnet structure 14, 28, 30 in the direction in which excursion of the diaphragm 12 occurs is eliminated.

What is claimed is:

1. In an electrodynamic transducer comprising a magnet structure including first and second poles defining between themselves an air gap, a diaphragm, a voice coil, and means for coupling the voice coil to the diaphragm, the improvement wherein openings are provided in at least one of the poles, the openings extending substantially parallel with the air gap and the direction of motion of the voice coil in the air gap and wherein the means for coupling the voice coil to the diaphragm comprises ribs extending transversely across the air gap and securing the voice coil to the diaphragm.

2. The apparatus of claim 1 wherein the first and second poles comprise an inner pole and an outer pole, respectively, the voice coil having a substantially cylindrical configuration, and the air gap having a substantially cylindrical configuration, the ribs extending substantially radially of the axes of the voice coil and air gap between the voice coil and diaphragm.

3. The apparatus of claim 2 wherein the diaphragm comprises an opening having an inner sidewall and the ribs are secured at their radially outer extents to the inner sidewall.

4. The apparatus of claim 3 wherein the inner sidewall of the opening in the diaphragm is substantially cylindrical.

5. The apparatus of claim 4 wherein the inner sidewall of the opening in the diaphragm is substantially right circular cylindrical.

6. The apparatus of claim 5 wherein the diaphragm is substantially planar.

7. The apparatus of claim 2 wherein the air gap and voice coil are substantially right circular cylindrical.

8. The apparatus of claim 2 wherein the openings are in the outer pole and are in the shape of slots which are elongated in the direction of the air gap and voice coil axes and narrow in a direction transverse to the air gap and voice coil axes.

9. The apparatus of claim 8 wherein the ribs are elongated in the direction of the air gap and voice coil axes and narrow in a direction transverse to the air gap and voice coil axes.

10. The apparatus of claim 2 wherein the means for coupling the voice coil to the diaphragm further comprises a voice coil form for supporting the voice coil in the air gap, the ribs secured at their radially inner extents to the voice coil form.

* * * * *